United States Patent [19]

Borcher, Sr. et al.

[11] Patent Number: 4,849,257

[45] Date of Patent: Jul. 18, 1989

[54] ARTICLES AND METHODS FOR TREATING FABRICS IN DRYER

[75] Inventors: Thomas A. Borcher, Sr., Cincinnati; Toan Trinh; Raymond E. Bolich, Jr., both of Maineville, all of Ohio

[73] Assignee: The Procter & Gamble Company, Cincinnati, Ohio

[21] Appl. No.: 126,662

[22] Filed: Dec. 1, 1987

[51] Int. Cl.[4] ..... B05D 3/12; D06M 21/02

[52] U.S. Cl. ..... 427/242; 34/9; 34/11; 252/8.6; 252/8.7; 252/8.75; 252/8.8; 252/8.9; 428/136

[58] Field of Search ..... 252/8.6, 8.8, 8.75, 252/8.9, 8.7; 427/242, 11; 34/9, 11; 428/136

[56] References Cited

U.S. PATENT DOCUMENTS

| | | | |
|---|---|---|---|
| 3,416,952 | 12/1968 | McIntyre et al. | 428/482 |
| 3,442,692 | 5/1969 | Gaiser | 427/240 |
| 3,632,396 | 1/1972 | Perez-Zamora | 428/291 |
| 3,686,025 | 8/1972 | Morton | 428/219 |
| 3,936,538 | 2/1976 | Marshall et al. | 427/242 |
| 3,959,230 | 5/1976 | Hays | 528/297 |
| 3,962,152 | 6/1976 | Nicol et al. | 252/551 |
| 4,073,996 | 2/1978 | Bedenk et al. | 428/274 |
| 4,103,047 | 7/1978 | Zaki et al. | 427/242 |
| 4,237,155 | 12/1980 | Kardouche | 427/242 |
| 4,238,531 | 12/1980 | Rudy et al. | 427/242 |
| 4,511,495 | 4/1985 | Melville | 427/242 X |
| 4,526,694 | 7/1985 | Puchta et al. | 252/8.8 |
| 4,749,596 | 6/1988 | Evans et al. | 427/242 |

FOREIGN PATENT DOCUMENTS 1092435 11/1967 United Kingdom .

*Primary Examiner*—Evan Lawrence

*Attorney, Agent, or Firm*—Leonard Williamson; Richard C. Witte

[57] ABSTRACT

Dryer-added fabric conditioning articles and methods utilizing a fabric conditioning composition which is released in the dryer by a dispensing means, the fabric conditioning composition comprising an improved uniform and stable mixture of: a polymeric soil release agent, particularly a higher molecular weight or a higher viscosity polymeric soil release agent, a dispersing aid, a fabric softening agent, and a viscosity control agent. The dispersing aid is used to improve the stability and the uniformity of the fabric conditioning composition.

19 Claims, No Drawings

ARTICLES AND METHODS FOR TREATING FABRICS IN DRYER

TECHNICAL FIELD

The present invention encompasses articles and methods for providing soil release, softening and antistatic benefits to fabrics in an automatic laundry dryer. More specifically, damp fabrics are commingled with softener active and polymeric soil release agent in an automatic clothes dryer and are provided with a soft, antistatic finish and soil release benefits concurrently with the drying operation. The softening and antistatic soil release agents herein are preferably employed in combination with a dispensing means adapted for use in an automatic dryer.

BACKGROUND OF THE INVENTION

Treatment in an automatic clothes dryer has been shown to be an effective means for imparting desirable tactile properties to fabrics. For example, it is becoming common to soften fabrics in an automatic clothes dryer rather than during the rinse cycle of a laundering operation. (See U.S. Pat. No. 3,442,692, Gaiser, issued May 6, 1969.)

Fabric "softness" is an expression well defined in the art and is usually understood to be that quality of the treated fabric whereby its handle or texture is smooth, pliable and fluffy to the touch. Various chemical compounds have long been known to possess the ability to soften fabrics when applied to them during a laundering operation.

The term fabric "softness" also connotes the absence of static "cling" in the fabrics, and the community used cationic fabric softeners provide both softening and antistatic benefits when applied to fabrics. Indeed, with fabrics such as nylon and polyester, the user is more able to perceive and appreciate an antistatic benefit than a true softening benefit.

On the other hand, soil release treatment of fabrics in an automatic clothes dryer is not as common as softening treatment.

U.S. Pat. No. 4,238,531, Rudy et al., issued Dec. 9, 1980, discloses in its Examples 8 and 9 a soil release agent adjuvant plus a "distributing aid," polyethylene glycol (PEG). The key combination of fabric softening plus soil release treatment in one automatic clothes dryer product is not disclosed in Rudy et al.

An improved dryer-added fabric conditioning article containing a mixture of a fabric softening agent and a polymeric soil release agent impregnated on a flexible substrate is disclosed in U.S. Pat. No. 4,749,596, M. D. Evans et al., issued June 7, 1988; said patent is incorporated herein by reference. This article provides soil release and fabric softening benefits for use in automatic dryers.

It was found, however, that the mixing of polyoxyethylene terephthalate soil release polymers, particularly those of higher molecular weights or higher viscosities, with the fabric softening agent did not occur except with vigorous agitation. When agitation ceased, phase separation occurred readily. An additional problem associated with the use of a nonhomogenous mixture is the separation of actives at the point of application of the active mixture on the substrate resulting in unevenly impregnated sheets.

It is therefore an object of the present invention to provide a stable and initimately mixed, homogenous fabric conditioning composition containing polyoxyethylene terephthalate soil release polymer and fabric softening agent. Another object of the present invention is to provide a homogenous and stable composition containing said soil release polymer and fabric softening agent, said actives do not separate at the point of impregnation on the flexible substrate sheet. It is a further object of the present invention to provide articles in which the substrate sheets are coated evenly and uniformly with the conditioning actives. It is yet another object herein to provide articles which can be added to an automatic clothes dryer to provide fabric soil releasing plus softening benefits to the washed laundry. And it is an object of the invention to provide methods for conditioning fabrics.

These and other objects will become obvious from the following disclosure.

SUMMARY OF THE INVENTION

The present invention encompasses an article of manufacture adapated for use to provide fabric soil release benefits and to soften fabrics in an automatic laundry dryer comprising:

(a) a fabric conditioning composition comprising a polymeric soil release agent, a dispersing aid, a fabric softening agent and a viscosity control agent, and (b) a dispensing means which provides for release of an effective amount of said composition to fabrics in an automatic dryer at operating temperatures of from about 35° C. to about 115° C.

The invention also encompasses a method for imparting soil releasing benefits plus a softening and antistatic effect to fabrics in an automatic clothes dryer comprising tumbling said fabrics under heat in a clothes dryer with an effective amount of said fabric conditioning composition.

DESCRIPTION OF THE PREFERRED EMBODIMENT

The present invention provides improved stable and uniform fabric conditioning compositions which can be prepared by mixing a soil release polymer using a dispersing aid with substantial levels of a fabric softening agent and a particulate clay viscosity control agent. Such compositions can be impregnated or coated evenly and uniformly on a flexible substrate sheet for treating fabric in an automatic laundry dryer.

The present invention comprises:

(a) an improved stable and uniform solid fabric conditioning composition being flowable at dryer operating temperatures, said composition comprising a mixture of:

i. 1% to 70% of a polymeric soil release agent having a molecular weight of from about 500 to about 60,000;

ii. 0.25% to 20% of a dispersing aid including suitable selected fabric softening material;

iii. 0% to 90% of a fabric softening agent exclusive of said dispersing aid;

iv. 0.25% to 15% of a viscosity control agent; wherein said composition contains a total of at least 20% of said fabric softening material and said fabric softening agent; and (b) a dispensing means which provides for release of an effective amount of said composition to fabrics in an automatic dryer operating temperatures, i.e., 35° C. to 115° C.

When the dispensing means is a flexible substrate in sheet configuration the fabric conditioning composition is releasably affixed on the substrate to provide a weight ratio of conditioning composition to dry substrate ranging from about 10:1 to about 0.5:1.

The invention also encompasses a method for imparting soil releasing benefits plus a softening and antistatic effect to fabrics in an automatic clothes dryer comprising tumbling said fabrics under heat in a clothes dryer with an effective amount of a composition comprising softening active(s) and a soil release agent.

The term "fabric conditioning composition" as used herein is defined as a mixture of a polymeric soil release agent, a fabric softening agent, a dispersing aid and a viscosity control agent as defined herein.

The term "fabric softening material" as used herein is a dispersing aid which also has fabric softening properties and is distinguished from the fabric softening agents in that respect.

Polymeric Soil Release Agent

The polymeric soil release agents of the present invention are selected from soil release agents having a molecular weight of from about 500 to about 60,000. The present invention is also particularly useful for soil release polymeric agents having a molecular weight of at least about 5,000 or a neat viscosity of at least about 5,000 at 85° C. at a shear rate of from 1–10 $sec^{-1}$ using a Well-Brookfield cone/plate viscometer.

Soil release agents of the present invention include copolymers having blocks of ethylene terephthalate and polyoxyethylene terephthalate. Some preferred polymers are comprised of repeating units of ethylene terephthalate and polyoxyethylene terephthalate at a molar ratio of ethylene terephthalate units to polyoxyethylene terephthalate units of from about 25:75 to about 35:65, said polyoxyethylene terephthalate containing polyoxyethylene blocks having a molecular weight of from about 300 to about 2000. The molecular weight of this polymeric soil release agent is preferably in the range of from about 7,500 to about 55,000. These polymers are disclosed in U.S. Pat. No. 3,959,230, Hays, issued May 25, 1976, incorporated herein by reference.

The polymeric soil release agent is present in the fabric conditioning composition as a uniform fine dispersion.

Another preferred polymeric soil release agent is a crystallizable polyester copolymer with repeat units of ethylene terephthalate units containing 10–50% by weight of ethylene terephthalate units together with 50–90% by weight of polyoxyethylene terephthalate units, derived from a polyethylene glycol of average molecular weight of from about 300 to about 6,000, and the molar ratio of ethylene terephthalate units to polyoxyethylene terephthalate units in the crystallizable polymeric compound is between 2:1 and 6:1. A more preferred polymer is that wherein the polyoxyethylene terephthalate units are derived from a polyethylene glycol with an average molecular weight of from about 1,000 to about 4,000, and most preferably about 1,500. These polymers are disclosed in U.S. Pat. No. 3,416,952, McIntyre/Robertson, issued Dec. 17, 1968, incorporated herein by reference. Examples of these copolymers include the commercially available material Zelcon® 4780 (from DuPont Co.) and Milease® T (from ICI Americas Inc.), both have the Chemical Abstracts Service Registry No. 9016-88-0. Both Zelcon 4780 and Milease T are sold in the aqueous dispersion form containing up to 85% water. It is preferable to use the dehydrated polymer to prepare the fabric conditioning composition in order to avoid the incorporation of excess moisture which is believed to make the resulting fabric conditioning articles wet and sticky. The dehydrated polymer is obtained by drying the above-mentioned commercial dispersions, or can be obtained directly in the concentrated form from the manufacturers. Examples of the latter are Zelcon PG, obtained from DuPont Co., and the anhydrous form of Milease T, obtained from ICI Americas Inc. Both of these polymers have molecular weights of more than 5,000 and neat viscosities higher than 5,000 cps.

Another preferred polymeric soil release agent is disclosed in allowed U.S. Pat. Application Ser. No. 801,020, of Eugene P. Gosselink, filed Nov. 22, 1985, incorporated herein by reference, having the empirical formula:

$$X_2\text{-}(O\text{-}C_2H_4)_{n-2n}(OR^5)_{m-2m}(A-R^1-A-R^2)_u(A-R^3-A-R^2)_v(A-R^4-A)\text{-}$$

and is believed to have the formula:

$$X\text{-}[(OCH^2CH_2)_n(OR^5)_m][(A-R^1-A-R^2)_u(A-R^3-A-R^2)_v]-A-R^4-A[(R^5O)_m(CH_2CH_2O)_n]X$$

wherein the A moieties are essentially $$-\overset{O}{\overset{\|}{C}}O- \quad \text{or} \quad -\overset{O}{\overset{\|}{C}}O-$$

moieties; the $R^1$ moieties are essentially 1,4-phenylene moieties; and $R_2$ moieties are essentially ethylene moieties, or substituted ethylene moieties having $C_1$–$C_4$ alkyl or alkoxy substituents; the $R^3$ moieties are substituted $C_2$–$C_{18}$ hydrocarbylene moieties having at least one $-SO_3M$, $-COOM$, $-O[(R^5O)_m(CH_2CH_2O)_n]X$ or $-A[(R^2-A-R^4-A)]_w[(R^5O)_m(CH_2CH_2O)_n]X$ substituent or at least one moiety $-[A-(R^2-A-R^4-A)]_wR^2-A-$ crosslinked to another $R^3$ moiety; the $R^4$ moieties are $R^1$ or $R^3$ moieties, or a mixture thereof; each $R^5$ is $C_3$–$C_4$ alkylene, or the moiety $-R^2-A-R^6-$, wherein $R^6$ is a $C_1$–$C_{12}$ alkylene, alkenylene, arylene or alkarylene moiety; each M is H or a water-soluble cation; each X is H, $C_1$–$C_4$ alkyl or $$-\overset{O}{\overset{\|}{C}}R^7,$$

wherein $R^7$ is $C_1$–$C_4$ alkyl; m and n are numbers such that the moiety $-(CH_2CH_2O)-$comprises at least about 50% by weight of the moiety $-[(R^5O)_m(CH_2CH_2O)_n]-$, provided that when $R^5$ is the moiety $-R^2-A-R^6-$, m is 1; each n is at least about 5; u and v are numbers such that the sum of u+v is from about 3 to about 25; w is 0 or at least 1; and when w is at least 1, u, v and w are numbers such that the sum of u+v+w is from about 3 to about 25.

This latter polymer is particularly preferred when the formula is:

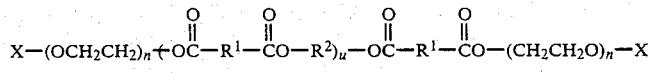

wherein each $R^1$ is a 1,4-phenylene moiety; the $R^2$ consist essentially of ethylene moieties, 1,2-propylene moieties or a mixture thereof; each X is ethyl or preferably methyl; each n is from about 12 to about 43; u is from about 1 to about 10.

A preferred polymeric solid release agent is POET (polyoxyethylene terephthalate), a compound with the general empirical and, it is believed, specific formulae described hereinabove. It is synthesized from the following reactants:

1. Poly(ethylene glycol)methyl ester, M.W. 750, Aldrich Chemical Co., 1000 g (1.33 moles)
2. Dimethyl terephthalate, M.W. 195, Aldrich Chemical Co., 359.9 g (1.85 moles)
3. Ethylene glycol, M.W. 62, Aldrich Chemical Co., 146.4 g (2.36 moles)
4. Calcium acetate, MCB, 7.9 g (catalyst)
5. Antimony trioxide, Fisher Scientific, 7.9 g (catalyst)
6. Butylated hydroxytoluene, Aldrich Chemical Co., 3.6 g (antioxidant).

The reaction is carried out by adding all of the above to a 2 liter round bottom flask equipped with mechanical agitation. A 14 inch unpacked column is also fitted to the flask for methanol distillation. The system is placed under a nitrogen atmosphere and the temperature is gradually raised to 200° C. once the reaction mixture melts. Reaction conditions of 200° C., atmospheric pressure, and constant mechanical agitation are maintained for 20 hours. To further drive the ester interchange reaction to completion, the reaction mixture is cooled to 130° C., the methanol receiving flask is emptied, and vacuum is applied while concurrently introducing nitrogen sparge below the level of the liquid reaction mixture. An absolute pressure of 25 mm Hg is obtained. Over a period of 2 hours the temperature is gradually raised to 190° C., distilling more methanol and ethylene glycol. To complete the reaction, the temperature is raised to 200° C. and the presssure is reduced to 20 mm Hg. The nitrogen flow into the reaction mixture is discontinued. After 3.5 hours, the reaction is essentially complete as indicated by reverse phase HPLC analysis. (Using a column packed with hexyl capped silica particles and an acetonitrile/water gradient elution). This analysis shows that a sizable part of the polymer contains 4 or more terephthalate units per molecule. The general formula for the resulting compound is believed to be:

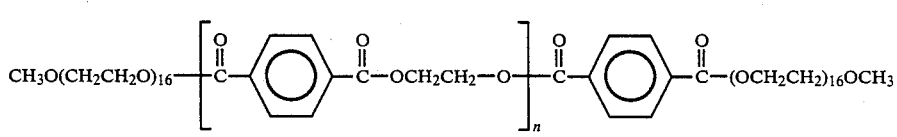

wherein n=1.75 on average.

The resulting polymer was submitted to a three-solvent (short chain alcohols) extraction (IPA, EtOH, MeOH) and the EtOH, MeOH soluble fractions are combined in the ratio of 67:33.

This extraction procedure results in a polymer sample containing predominantly 3 to 5 terephthalate units per molecule as shown by HPLC analysis.

Another preferred polymeric soil release agent has the following average structure:

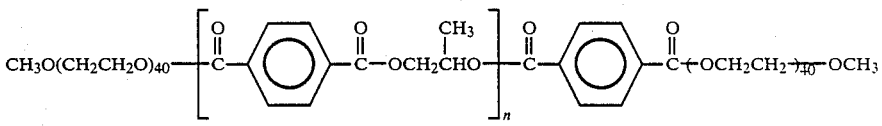

wherein n is about 4 to 6 on average.

In general, the polymeric soil release agent is preferably a solid at room temperature, has a softening phase transition temperature at or above 30° C. and becomes a flowable liquid below 100° C., more preferably below 90° C.

The polymeric soil release agent is present at a level of from about 1% to about 70% by weight of the total fabric conditioning composition, preferably from about 10% to about 60%, and most preferably from about 20% to about 50%.

Dispersing Aid

The dispersing aid for the present invention is required to disperse the polymeric soil release aid in the fabric conditioning composition so as to form an improved stable and uniform mixture.

It should be noted that the dispersing aids listed below as Components (ii)-(vi) and (x) are examples of dispersing aids which are also suitable fabric softening material. Thus, the fabric conditioning compositions of the present invention can include suitable selected fabric softening material, which serves as a dispersing aid.

The dispersing aid of this invention is preferably selected from a group consisting of:

(i) alkaline metal and ammonium salts of aromatic sulfonic acids or substituted aromatic sulfonic acids having the formula:

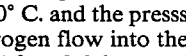

wherein Ar is an aromatic hydrocarbon group, each $R_1$ is a hydrogen radical or a $C_1$-$C_4$ alkyl group, n is from 0 to 3, and M is an alkaline metal or ammonium ion;

(ii) molecules or salts containing an aromatic moiety and a long chain acyclic aliphatic moiety, said molecules or salts having the formula:

$[R_1—Ar—(CH_2)_u—D—(R_2)_m]A$ wherein Ar and $R_1$ are defined as above, $R_2$ is an acyclic aliphatic $C_{12}$–$C_{22}$ hydrocarbon group, u is 0 or 1, m is 1 or 2, D is a suitable connecting group, and A is a counterion in the case said D group has a charge;

(iii) N-substituted pyridinium salts having the formula:

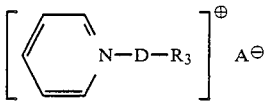

wherein $R_3$ is an acyclic aliphatic $C_{11}$–$C_{21}$ hydrocarbon group, and D and A are defined as above;

(iv) substituted imidazoline compounds having the formula:

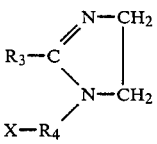

wherein $R_3$ is defined as above, $R_4$ is a divalent $C_1$–$C_3$ alkylene group, and X is selected from a group consisting of hydroxy, —OCO—$R_3$ or —NH—CO—$R_3$ group;

(v) substituted imidazolinium salts having the formula:

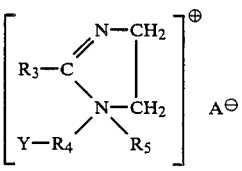

wherein $R_5$ is a hydrogen radical or a $C_1$–$C_4$ alkyl or hydroxyalkyl group, Y is selected from a group consisting of a hydrogen radical, a $C_1$–$C_2$ alkyl or hydroxyalkyl group, —NH—CO—$R_3$ or —O—CO—$R_3$ group, and $R_3$ and A are defined as above;

(vi) molecules or salts containing a long chain acyclic aliphatic moiety and a polyoxyethylene moiety, said molecules of salts having the formula:

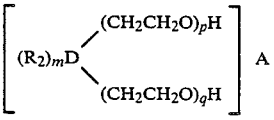

wherein $R_2$, D, A and m are defined as above, p and q are equal from 0 to 30 with p+q equal from 2 to 30;

(vii) polyoxyethylated alkylphenol having the formula:

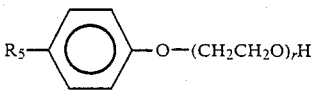

wherein $R_5$ is a straight or branched chain acyclic aliphatic $C_8$–$C_{22}$ hydrocarbon group and r is from 0 to 30; this is a special case of component (vi) above, in which D is a divalent phenylene group and q=0;

(viii) ethoxylated 2,4,7,9-tetramethyl-5-decyne-4,7-diol molecules having the formula:

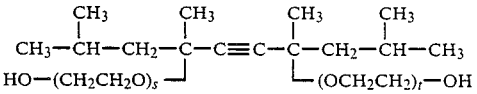

wherein s+t is equal from 2 to 30;

(ix) amine oxides having the formula $R_1R_6R_7NO$ wherein $R_1$ is defined as above, $R_6$ is a $C_8$–$C_{22}$ hydrocarbon group and $R_7$ is selected from the group consisting of $R_1$ and $R_6$ groups;

(x) N-alkyl pyrrolidones having the formula:

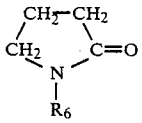

wherein $R_6$ is an acyclic aliphatic defined as above; and mixtures thereof.

The dispersing aid is used at a level of from about 0.25% to about 20% by weight of the fabric conditioning composition, preferably from about 1% to about 10%, and most preferably from about 2% to about 7%.

Examples of Component (i) are the well-known hydrotropes such as sodium, potassium or ammonium salts of cumenesulfonate, toluenesulfonate, xylenesulfonate or benzenesulfonate. They can be used in powder form or as concentrated aqueous solutions. The preferred dispensing aid is sodium cumenesulfonate.

Examples of Component (ii) are the alkylbenzyldimethylammonium salts and the dialkylbenzylmethylammonium salts, wherein the D connecting group is a trivalent $N^+CH_3$ group. Many of these materials are available commercially, such as alkyl ($C_{14}$–$C_{18}$) benzyldimethylammonium chloride, benzyldimethylstearylammonium chloride and di(hydrogenated tallow) methylbenzylammonium chloride, available from Sherex Chemical Company under the trade names Variquat® B-345, Varisoft® SDC, and Variquat B-343, respectively.

Examples of Component (iii) are the common N-alkyl ($C_{16}$–$C_{22}$) pyridinium chloride (I) and alkan($C_{15}$–$C_{21}$)amide ethylene pyridinium chloride (II) salts.

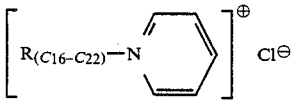

(I)

-continued

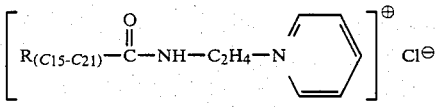

(II)

Examples of Component (iv) are stearic hydroxyethyl imidazoline (III) and 1-(hydrogenated tallow-)amidoethyl-2-(hydrogenated tallow)imidazoline (IV)

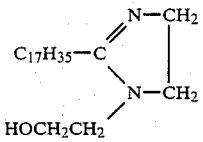

(III)

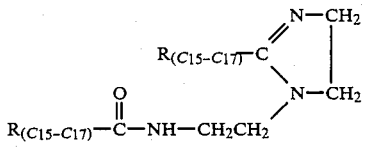

(IV)

In stearic hydroxyethyl imidazoline (III), $R_3$ is an aliphatic $C_{17}$ hydrocarbon group, $R_4$ is a divalent ethylene group and X is a hydroxy group. This chemical is sold under the trade name Alkazine® ST by Alkaril Chemicals, Inc. or Schercozoline ®S by Scher Chemicals, Inc., and Miramine TC by Miranol Chemical Company. In 1-(hydrogenated tallow)amidoethyl-2-(hydrogenated tallow)imidazoline (IV), $R_3$ is an aliphatic $C_{15}$–$C_{17}$ hydrocarbon group, $R_4$ is a divalent ethylene group, and X is a —NH—CO—R($C_{15}$–$C_{17}$) group. This chemical is the reaction product of hydrogenated tallow fatty acids and diethylenetriamine, and is the precursor of the cationic fabric softening agent methyl-1-(hydrogenated tallow)amidoethyl-2-(hydrogenated tallow)imidazolinium methylsulfate (V) (see "Cationic Surface Active Agents as Fabric Softeners", R. R. Egan, Journal of the American Oil Chemists' Society, January 1978, pages 118–121).

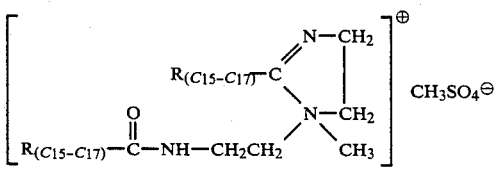

(V)

1-(Hydrogenated tallow)amidoethyl-2-(hydrogenated tallow) imidazoline can be obtained from Sherex Chemical Company as an experimental chemical. Its quaternized form (V) is an example of Component (v), and is available from Sherex Chemical Company under the trade name Varisoft 445.

Examples of Component (vi) are polyethoxylated fatty alcohols, alkyl bis(polyethoxyethanol)amine, bis(-polyethoxyethanol) fatty amide, ethylbis(polyethoxyethanol)alkylammonium salts, and methylbis(tallowamidoethyl)-2-(polyethoxyethanol)ethylammonium salts.

In polyethoxylated fatty alcohols an aliphatic $C_8$–$C_{18}$ hydrocarbon group is bonded to one polyethoxyethanol chain containing from 2 to about 30 oxyethylene units via a —$CH_2$— D group. Examples of commercially available materials are the Neodol$^R$ Ethoxylates, sold by Shell Chemical Company. Different grades of Neodol Ethoxylates, have an aliphatic hydrocarbon group containing from about 9 to about 15 carbon atoms and a polyethoxylate chain containing in average from 2.5 to 13 oxyethylene units.

In ethylbis(polyethoxyethanol)alkylammonium salts, D is a trivalent $N^{\oplus}C_2H_5$ group, m=1, p=1 to 30, q=1 to 30, and p +q=2 to 30. Examples of commercially available materials of this type are ethylbis(polyethoxyethanol)alkylammonium ethylsulfate sold by Sherex Chemical Company under the trade name Varstat® 66.

Examples of Component (vii) are the nonylphenoxypolyethoxy ethanol and octylphenoxypolyethoxy ethanol of different degrees of ethoxylation. Examples of commercially available nonylphenoxypolyethoxy ethanol are the Triton® N-87, N-101, N-111, N-302 and N-401, sold by Rohm and Haas Company, or the Surfonic® N-95, N-100, N-102, N-120, N-150, N-200 and N-300, sold by Texaco Chemical Company. Examples of commercially available octylphenoxypolyethoxy ethanol are Triton® X-45, X-100, X-102 and X-114, sold by Rohm and Haas Company.

Commercially available examples of Component (iii) are Surfynol® 440, 465 and 485 which have 3.5, 10 and 30 ethoxy units, respectively, and are sold by Air Products & Chemicals, Inc.

Examples of Component (ix) are didecylmethylamine oxide available from Ethyl Corporation and stearyldimethylamine oxide available from Scher Chemicals, Inc., under the trade name Schercamox DMS.

Examples of Component (x) are n-octyl pyrrolidone, n-dodecyl pyrrolidone, dodecyl/tetradecyl pyrrolidone, hexadecyl pyrrolidone, and octadecyl pyrrolidone. These materials are available from GAF Chemicals Corp.

Fabric Softening Agent

The term "fabric softening agent" as used herein includes cationic and nonionic fabric softeners used alone and also in combination with each other. The preferred fabric softening agent of the present invention is a mixture of cationic and nonionic fabric softeners.

The fabric softening agent is used at a level of from about 0% to about 90% by weight of the total fabric conditioning composition, exclusive of dispersing aids having fabric softening benefits. However, the minimum total level of dispersing aid fabric softening material and fabric softening agent is about 20% by weight of the fabric conditioning composition. Preferably the level of fabric softening agent is from about 30% to about 80%, and most preferably from about 40% to about 70%.

Examples of fabric softening agents are described in detail in U.S. Pat. Nos. 4,103,047, Zaki et al., issued July 25, 1978; 4,237,155, Kardouche, issued Dec. 2, 1980; 3,686,025, Morton, issued Aug. 22, 1972; 3,849,435, Diery et al., issued Nov. 19, 1974; and U.S. Pat. No. 4,037,996, Bedenk, issued Feb. 14, 1978; said patents are incorporated herein by reference.

Particularly preferred cationic fabric softening agents include acyclic quaternary ammonium salts having the formula:

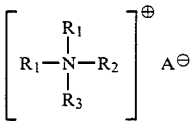

wherein $R_1$ is an acyclic aliphatic $C_{12}$–$C_{22}$ hydrocarbon group, $R_2$ is a $C_1$–$C_4$ alkyl or hydroxyalkyl group, $R_3$ is selected from the group consisting of $R_1$ and $R_2$ groups, and A is an anion preferably selected from the group consisting of methylsulfate, ethylsulfate and chloride ions. Examples of such preferred cationic materials include ditallowalkyldimethylammonium methylsulfate, distearyldimethylammonium methylsulfate, dipalmityldimethylammonium methylsulfate and dibehenyldimethylammonium methylsulfate.

Also preferred are fatty acids salts of tertiary alkyl amines having the formula:

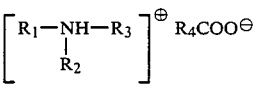

wherein $R_1$, $R_2$ and $R_3$ are defined as above and $R_4$ is an acyclic aliphatic $C_{11}$–$C_{21}$ hydrocarbon group. Examples includes stearyldimethylammonium stearate, distearylmethylammonium myristate, stearyldimethylammonium palmitate, distearylmethylammonium palmitate, and distearylmethylammonium laurate. These carboxylic salts can be made in situ by mixing the corresponding amine and carboxylic acid in the molten fabric conditioning composition.

Examples of the nonionic softening agents are $C_{12}$–$C_{22}$ fatty alcohols, and fatty amines having the formula $R_1R_2R_3N$ wherein $R_1$, $R_2$, $R_3$ are defined above, and mixtures of said fatty alcohols and fatty amines.

Another preferred fabric softening agent comprises a carboxylic acid salt of a tertiary amine, such as mixtures of stearyldimethylammonium stearate and stearyldimethylammonium palmitate, in combination with a fatty alcohol such as stearyl alcohol, and a quaternary ammonium salt such as ditallowalkyldimethylammonium methylsulfate. In this combination the carboxylic acid salt of a tertiary amine is used at a level of from about 5% to about 50% of the fabric conditioning composition. The fatty alcohol can be used at a level of from about 5 to about 15% of the fabric conditioning composition. The quaternary ammonium salt is used at a level of from about 5% to about 25%.

Viscosity Control Agent

The viscosity control agent is used to establish and maintain a fabric conditioning composition viscosity in the range of from about 200 cps to about 40,000 cps, more preferably from about 1,500 cps to about 15,000 cps, and most preferably from about 2,000 cps to about 10,000 cps, as determined at 70° C. temperature and at a shear rate of 10 $sec^{-1}$ using a Wells-Brookfield cone/-plate viscometer.

The preferred viscosity control agent is particulate clay. Examples of the particulate clays useful in the present invention are described in U.S. Pat. No. 4,073,996, Bedenk et al., issued Feb. 14, 1978, and incorporated herein by reference. A preferred clay material is calcium bentonite clay sold by Southern Clay Products under the trade name Bentolite ® L. The viscosity control agent is present at a level of from about 0.25% to about 15% by weight of the fabric conditioning composition, preferably from about 1% to about 10%, and most preferably from about 3% to about 8%.

Optional Ingredients

A very desirable optional ingredient is perfume, very useful to impart odor benefits. Perfume is present at a level of from about 0.25% to about 10% by weight of the fabric conditioning composition. Other well-known optional components included in the fabric conditioning composition which are useful in the present invention are narrated in U.S. Pat. No. 4,103,047, supra, for "Fabric Treatment Compositions," incorporated herein by reference.

Dispensing Means

The fabric conditioning compositions can be employed by simply adding a measured amount into the dryer, e.g., as liquid dispersion. However, in a preferred embodiment, the fabric conditioners are provided as an article of manufacture in combination with a dispensing means such as a flexible substrate which effectively releases the composition in an automatic clothes dryer. Such dispensing means can be designed for single usage or for multiple uses.

One such article comprises a sponge material releasably enclosing enough fabric conditioning composition to effectively impart fabric soil release and softness benefits during several cycles of clothes. This multi-use article can be made by filling a hollow sponge with about 20 grams of the fabric conditioning composition.

Other devices and articles suitable for dispensing the fabric conditioning composition into automatic dryers include those described in U.S. Pat. Nos. 4,103,047, supra; 3,736,668, Dillarstone, issued June 5, 1973; 3,701,202, Compa et al., issued Oct. 31, 1972; 3,634,947, Furgal, issued Jan. 18, 1972; 3,633,538, Hoeflin, issued Jan. 11, 1972; and 3,435,537, Rumsey, issued Apr. 1, 1969. All of these patents are incorporated herein by reference.

A highly preferred article herein comprises the fabric conditioning composition releasably affixed to a flexible substrate in a sheet configuration.

Highly preferred paper, woven or nonwoven "absorbent" substrates useful herein are fully disclosed in U.S. Pat. No. 3,686, 025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Determination of absorbent capacity values is made by using the capacity testing procedures described in U.S. Federal Specifications UU-T-595b, modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification.

Based on this test, one-ply, dense bleached paper (e.g., kraft or bond having a basis weight of about 32 pounds per 3,000 square feet) has an absorbent capacity of 3.5 to 4, commercially available household one-ply toweling paper has a value of 5 to 6; and commercially available two-ply household toweling paper has a value of 7 to about 9.5.

Using a substrate with an absorbent capacity of less than 4 tends to cause too rapid release of the fabric conditioning composition from the substrate resulting in several disadvantages, one of which is uneven conditioning of the fabrics. Using a substrate with an absorbent capacity over 12 is undesirable, inasmuch as too little of the fabric conditioning composition is released to condition the fabrics in optimal fashion during a normal drying cycle.

Such a substrate comprises a nonwoven cloth having an absorbent capacity of preferably from about 5 to 7 and wherein the weight ratio of fabric conditioning composition to substrate on a dry weight basis ranges from about 5:1 to 1:1.

Nonwoven cloth substrate preferably comprises cellulosic fibers having a length of from 3/16 inch to 2 inches and a denier of from 1.5 to 5 and the substrate is adhesively bonded together with a binder resin.

The flexible substrate preferably has openings sufficient in size and number to reduce restriction by said article of the flow of air through an automatic laundry dryer. The better openings comprise a plurality of rectilinear slits extended along one dimension of the substrate.

Usage

The method aspect of this invention for imparting the abovedescribed fabric conditioning composition to provide soil release, softening and antistatic effects to fabrics in an automatic laundry dryer comprises: commingling pieces of damp fabrics by tumbling said fabrics under heat in an automatic clothes dryer with an effective amount of the fabric conditioning composition, said composition having a melting point greater than about 38° C. and being flowable at dryer operating temperature, said composition comprising from about 10% to 70% of a polymeric soil release agent, and 30% to 90% of a fabric softening agent selected from the above-defined cationic and nonionic fabric softeners and mixtures thereof.

The method herein is carried out in the following manner. Damp fabrics, usually containing from about 1 to about 2.5 times their weight of water, are placed in the drum of an automatic clothes dryer. In practice, such damp fabrics are commonly obtained by laundering, rinsing and spin-drying the fabrics in a standard washing machine. The fabric conditioning composition can simply be spread uniformly over all fabric surfaces, for example, by sprinkling the composition onto the fabrics from a shaker device. Alternatively, the composition can be sprayed or otherwise coated on the dryer drum, itself. The dryer is then operated in standard fashion to dry the fabrics, usually at a temperature from about 50° C. to about 80° C. for a period from about 10 minutes to about 60 minutes, depending on the fabric load and type. On removal from the dryer, the dried fabrics have been treated for soil release benefits and are softened. Moreover, the fabrics instantaneously sorb a minute quantity of water which increases the electrical conductivity of the fabric surfaces, thereby quickly and effectively dissipating static charge.

In a preferred mode, the present process is carried out by fashioning an article comprising the substrate-like dispensing means of the type hereinabove described in releasable combination with a fabric conditioning composition. This article is simply added to a clothes dryer together with the damp fabrics to be treated. The heat and tumbling action of the revolving dryer drum evenly distributes the composition over all fabric surfaces, and dries the fabrics.

EXAMPLES

The present invention is illustrated in the light of the following nonlimiting examples. Examples 1, 5, 9 and 10 each have a fabric conditioning coating mix composition consisting of: (a) a soil release component, (b) a dispersing agent (e.g., sodium cumenesulfonate), (c) a fabric softener component and (d) a viscosity control component. Each of these components can be a single chemical or can be a mixture of chemicals as disclosed in the Description of the Preferred Embodiment (vide supra). Such compositions yield uniformly impregnated dryer-added fabric conditioning sheets, and are within the scope of the present invention.

Comparative Examples 2–4, 6–8, and 11 illustrate compositions which give unsatisfactory results, due to phase instability and/or nonuniform sheet coating.

| Examples<br>Fabric Conditioning<br>Composition Components | 1<br>Wt % | 2<br>Wt % | 3<br>Wt % |
|---|---|---|---|
| Fabric Softening Agent | | | |
| DTDMAMS[a] | 51.6 | 60.0 | 54.0 |
| Stearyldimethylamine | — | — | — |
| $C_{16}$–$C_{18}$ Fatty Acid | — | — | — |
| $C_{16}$–$C_{18}$ Fatty Alcohol | — | — | — |
| (Total Fabric Softener) | (51.6) | (60.0) | (54.0) |
| Soil Release Agent | | | |
| Zelcon PG[b] | 34.3 | 40.0 | 36.0 |
| Viscosity Control Agent | | | |
| Bentolite L Clay[c] | 4.0 | — | — |
| Dispersing Aid[d] | | | |
| Sodium Cumenesulfonate[e] | 10.0 (4.5) | — | 10.0 (4.5) |
| Total | 100.0 | 100.0 | 100.0 |

| Examples<br>Fabric Conditioning<br>Composition Components | 4<br>Wt % | 5<br>Wt % | 6<br>Wt % |
|---|---|---|---|
| Fabric Softening Agent | | | |
| DTDMAMS | 57.6 | 10.3 | 12.1 |
| Stearyldimethylamine | — | 12.8 | 15.0 |
| $C_{16}$–$C_{18}$ Fatty Acid | — | 11.7 | 13.8 |
| $C_{16}$–$C_{18}$ Fatty Alcohol | — | 10.3 | 12.1 |
| (Total Fabric Softener) | (57.6) | (45.1) | (53.0) |
| Soil Release Agent | | | |
| Zelcon PG | 38.4 | 40.0 | 47.0 |
| Viscosity Control Agent | | | |
| Bentolite L Clay | 4.0 | 6.0 | — |
| Dispersing Aid[d] | | | |
| Sodium Cumenesulfonate[e] | — | 8.9 (4.0) | — |
| Total | 100.0 | 100.0 | 100.0 |

| Examples<br>Fabric Conditioning<br>Composition Components | 7<br>Wt % | 8<br>Wt % | 9<br>Wt % |
|---|---|---|---|
| Fabric Softening Agent | | | |
| DTDMAMS | 11.0 | 11.3 | 10.55 |
| Stearyldimethylamine | 13.6 | 14.1 | 13.05 |
| $C_{16}$–$C_{18}$ Fatty Acid | 12.6 | 13.1 | 12.06 |
| $C_{16}$–$C_{18}$ Fatty Alcohol | 11.0 | 11.3 | 10.55 |
| (Total Fabric Softener) | (48.2) | (49.8) | (46.21) |
| Soil Release Agent | | | |
| Zelcon PG | 42.9 | 44.2 | — |
| Milease T[f] | — | — | 39.15 |

-continued

| | | | |
|---|---|---|---|
| Viscosity Control Agent | | | |
| Bentolite L Clay | — | 6.0 | 5.74 |
| Dispersing Aid[d] | | | |
| Sodium Cumenesufonate[e] | 8.9 (4.0) | — | 8.9 (4.0) |
| Total | 100.0 | 100.0 | 100.00 |
| Examples | | | |
| Fabric Conditioning Composition Components | 10 Wt % | 11 Wt % | 12 Wt % |
| Fabric Softening Agent | | | |
| DTDMAMS | 11.12 | 11.58 | 10.57 |
| Stearyldimethylamine | 13.75 | 14.32 | 13.21 |
| $C_{16}$–$C_{18}$ Fatty Acid | 12.71 | 13.24 | 12.15 |
| $C_{16}$–$C_{18}$ Fatty Alcohol | 11.12 | 11.58 | 10.57 |
| (Total Fabric Softener) | (48.70) | (50.72) | (46.50) |
| Soil Release Agent | | | |
| Zelcon PG | — | — | 39.64 |
| Milease T[f] | 41.25 | 42.98 | — |
| Viscosity Control Agent | | | |
| Bentolite L Clay | 6.05 | 6.30 | 4.24 |
| Dispersing Aid[d] | | | |
| Sodium Cumenesulfonate[e] | 4.00[m] | — | 7.40 (3.33)[e] |
| Optional Ingredient | | | |
| Perfume | — | — | 2.22 |
| Total | 100.0 | 100.00 | 100.00 |

[a]DTDMAMS is ditallowdimethylammonium methylsulfate.
[b]Zelcon PG is polyethylene terephthalate-polyoxyethylene terephthalate copolymer obtained from DuPont Co. It is described hereinabove in the section entitled "polymeric Soil Release Agent."
[c]Bentolite L sold by Southern Clay Products.
[d]Amount given is percentage of the bulk dispersing aid; amount given in parentheses is percentage of the pure active.
[e]Aqueous solution, 45% active.
[d]Amount given is percentage of the bulk dispersing aid; amount given in parentheses is percentage of the pure active.
[e]Aqueous solution, 45% active.
[f]Anhydrous form of Milease T, a polyethylene terephthalate-polyoxyethylene terephthalate copolymer obtained from ICI Americas. It is described hereinabove in the section entitled "Polymeric Soil Release Agent."
[m]100% powdered form.

Example 1

Example 1 of the present invention is a four-component fabric conditioning composition impregnated on a nonwoven fabric substrate and is made by the following procedure:

Ten parts of sodium cumenesulfonate aqueous solution (45% active by weight) was added to 34.4 parts of Zelcon PG, and the blend was liquefied at 80° C. and mixed well. This mixture was added with stirring to 51.6 parts of molten DTDMAMS at 80° C. in a high shear mixer. An amount of 4 parts of Bentolite L clay was then added to the mixture with high shear mixing into a creamy blend.

Each nonwoven substrate, comprised of 70% 3-denier, 1 9/16 in. long rayon fibers with 30% polyvinyl acetate binder, was cut into a 9 in. × 11 in. sheet. An amount of fabric conditioning composition slightly more than target coating weight (3.7 g) was distributed on a heating plate and the nonwoven cloth was placed over it. A small paint roller was used to impregnate the mixture into the interstices of the substrate. The article was removed from the hot plate and allowed to cool to room temperature whereby the mixture solidified. The composition was evenly and uniformly applied to the nonwoven substrate sheet.

The article was weighed to determine the coating weight. If the coating weight was less than target weight, more fabric conditioning composition would be applied to the heating plate and the impregnated substrate sheet was replaced on the heating plate to pick up some more active with the paint roller. On the other hand, if the coating weight was more than the target weight, the remaining fabric conditioning composition on the heating plate would be wiped off, and the impregnated substrate sheet was replaced on the heating plate, pressed to the plate surface with the paint roller to release some of the active.

Following solidification of the fabric conditioning composition, the cloth was slit with a knife. (Conveniently, the cloth was provided with 3 to 9 rectilinear slits extending along one dimension of the substrate, said slits being in substantially parallel relationship and extending to within about 1 in. from at least one edge of said dimension of the substrate). The width of an individual slit was about 0.2 in.

COMPARATIVE EXAMPLE 2

The two-component composition of Example 2 was prepared by high shear mixing of molten Zelcon PG with molten DTDMAMS at 80° C. However, Zelcon separated from DTDMAMS phase as soon as the mixing stopped. No impregnation of this composition on nonwoven substrate was done.

COMPARATIVE EXAMPLE 3

The three-component composition of Example 3 was prepared by high shear mixing of the Zelcon PG and sodium cumenesulfonate blend with DTDMAMS at 80° C. Zelcon also separated from DTDMAMS phase when the mixing stopped, and no coating on substrate was done.

COMPARATIVE EXAMPLE 4

The three-component composition of Example 4 was prepared by the procedure of Example 1. A thick, visually uniform mixture was obtained. However, when the composition was spread on a nonwoven substrate sheet with a paint roller, a nonuniform coating was obtained, with some Zelcon droplets stuck to the paint roller.

EXAMPLES 5–8

Examples 5–8 are similar to Examples 1–4 with the exception that the fabric softener component consists of a mixture of DTDMAMS, stearyldimethylamine, fatty acid and fatty alcohol, instead of just DTDMAMS. This mixture was obtained by first melting the stearyldimethylamine and fatty acid blend at 80° C., followed by adding fatty alcohol and DTDMAMS and melting and mixing the whole mixture at 80° C. The results were also similar in that the composition of Example 5 coated the nonwoven substrate unevenly and uniformly; but the two-component composition of Comparative Example 6 and three-component composition of Comparative Example 7 were unstable (separation of Zelcon) and the three-component composition of Comparative Example 8 resulted in nonuniform coating of the substrate.

EXAMPLE 9

Example 9 is similar to Example 5 with the exception that concentrated Milease T was used instead of Zelcon PG. The Milease was melted in a microwave oven. The resulting mixture was uniform and easily impregnated on the nonwoven substrate to yield even and uniform sheets.

EXAMPLE 10

Example 10 is similar to Example 9 with the exception that the powdered sodium cumenesulfonate solid was used instead of the 45% aqueous solution. The powdered sodium cumenesulfonate was premixed with the soil release agent. The resulting mixture of the present invention was uniform and easily impregnated on the nonwoven substrate to yield even and uniform sheets.

COMPARATIVE EXAMPLE 11

Comparative Example 11 is similar to Examples 9 and 10 with the exception that no dispersing aid is used, resulting in phase instability and nonuniform substrate coating.

EXAMPLE 12

A dryer-added fabric conditioning article comprising a rayon nonwoven fabric substrate (having a weight of 1.22 gm per 99 sq. in.) and a fabric conditioning composition is prepared in the following manner.

A fabric softening agent premixture is initially prepared by admixing 1321 parts octadecyldimethylamine with 1215 parts $C_{16}$–$C_{18}$ fatty acid at 70° C. The softening agent mixture is completed by then adding and mixing in 1057 parts $C_{16}$–$C_{18}$ fatty alcohol and 1057 parts ditallowdimethylammonium methylsulfate at 70° C. To the softening agent mixture, 3964 parts of premelted Zelcon PG soil release agent at 85° C. is added slowly and with high shearing followed by the addition of 740 parts of a 45% aqueous solution of sodium cumenesulfonate with continuous high shearing to finely disperse the polymer. After the addition is completed and a sufficient period of mixing time has elapsed, 424 parts of Bentolite L particulate clay is added slowly while maintaining the high-shear mixing action. An amount of 222 parts of perfume is added to complete the preparation of the fabric conditioning composition.

The flexible substrate, comprised of 70% 3-denier, 1 9/16 in. long rayon fibers and 30% polyvinyl acetate binder, is impregnated by coating one side of a continuous length of the substrate and contacting it with a rotating cylindrical member which serves to press the liquified mixture into the interstices of the substrate. The substrate is passed over several chilled tension rolls which help solidify the conditioning mixture. The substrate sheet is 9 in. wide and is perforated in lines at 11 in. intervals to provide detachable sheets. Each sheet is cut with a set of knives to provide three evenly spaced parallel slits averaging about 4 in. in length.

EXAMPLES 13–26

The following Examples 13–26 further illustrate the benefits achieved by the compositions and methods of the present invention. The even numbered ones (Examples 14, 16, etc.) are of the present invention, but are not to be construed as limiting thereof. These compositions were made following the procedure described in Examples 1 and 5.

The compositions of comparative examples with odd numbers (Example 13, 15, etc.) all do not contain a viscosity control component. These compositions were made following the procedure described in Comparative Examples 3 and 7. These compositions were unstable, and are outside the scope of the present invention.

| Examples Fabric Conditioning Composition Components | 13 Wt % | 14 Wt % | 15 Wt % | 16 Wt % |
|---|---|---|---|---|
| Fabric Softening Agent | | | | |
| DTDMAMS | 11.4 | 10.7 | 11.6 | 10.8 |
| Stearyldimethylamine | 14.2 | 13.3 | 14.4 | 13.5 |
| $C_{16}$–$C_{18}$ Fatty Acid | 13.1 | 12.3 | 13.2 | 12.5 |
| $C_{16}$–$C_{18}$ Fatty Alcohol | 11.4 | 10.7 | 11.6 | 10.8 |
| (Total Fabric Softener) | (50.1) | (47.0) | (50.8) | (47.6) |
| Soil Release Agent | | | | |
| Zelcon PG | 44.6 | 41.7 | 45.2 | 42.4 |
| Viscosity Control Agent | | | | |
| Bentolite L Clay | — | 6.0 | — | 6.0 |
| Dispersing Aid[d] | | | | |
| Variquat B-343[g] | 5.3 (4.0) | 5.3 (4.0) | — | — |
| Alkazine ST[h] | — | — | 4.0 | 4.0 |
| Total | 100.0 | 100.0 | 100.0 | 100.0 |

| Examples Fabric Conditioning Composition Components | 17 Wt % | 18 Wt % | 19 Wt % | 20 Wt % |
|---|---|---|---|---|
| Fabric Softening Agent | | | | |
| DTDMAMS | 11.4 | 10.7 | 11.4 | 10.7 |
| Stearyldimethylamine | 14.2 | 13.3 | 14.2 | 13.3 |
| $C_{16}$–$C_{18}$ Fatty Acid | 13.1 | 12.3 | 13.1 | 12.3 |
| $C_{16}$–$C_{18}$ Fatty Alcohol | 11.4 | 10.7 | 11.4 | 10.7 |
| (Total Fabric Softener) | (50.1) | (47.0) | (50.1) | (47.0) |
| Soil Release Agent | | | | |
| Zelcon PG | 44.6 | 41.7 | — | — |
| Milease | — | — | 44.6 | 41.7 |
| Viscosity Control Agent | | | | |
| Bentolite L Clay | — | 6.0 | — | 6.0 |
| Dispersing Aid[d] | | | | |
| Varisoft 455[i] | 5.3 (4.0) | 5.3 (4.0) | 5.3 (4.0) | 5.3 (4.0) |
| Total | 100.0 | 100.0 | 100.0 | 100.0 |

| Examples Fabric Conditioning Composition Components | 21 Wt % | 22 Wt % | 23 Wt % | 25 Wt % |
|---|---|---|---|---|
| Fabric Softening Agent | | | | |
| DTDMAMS | 11.4 | 10.7 | 11.6 | 10.8 |
| Stearyldimethylamine | 14.2 | 13.2 | 14.4 | 13.5 |
| $C_{16}$–$C_{18}$ Fatty Acid | 13.0 | 12.2 | 13.2 | 12.5 |
| $C_{16}$–$C_{18}$ Fatty Alcohol | 11.4 | 10.7 | 11.6 | 10.8 |
| (Total Fabric Softener) | (50.1) | (46.8) | (50.8) | (47.6) |
| Soil Release Agent | | | | |
| Zelcon PG | 44.4 | 41.6 | 45.2 | 42.4 |
| Viscosity Control Agent | | | | |
| Bentolite L Clay | — | 6.0 | — | 6.0 |
| Dispersing Aid[d] | | | | |
| Varstat 66[j] | 5.6 (4.0) | 5.6 (4.0) | — | — |
| Triton N-101[k] | — | — | 4.0 | 4.0 |
| Total | 100.0 | 100.0 | 100.0 | 100.0 |

| Examples Fabric Conditioning Composition Components | 25 Wt % | 26 Wt % |
|---|---|---|
| Fabric Softening Agent | | |
| DTDMAMS | 11.6 | 10.8 |
| Stearyldimethylamine | 14.4 | 13.5 |
| $C_{16}$–$C_{18}$ Fatty Acid | 13.2 | 12.5 |
| $C_{16}$–$C_{18}$ Fatty Alcohol | 11.6 | 10.8 |
| (Total Fabric Softener) | (50.8) | (47.6) |
| Soil Release Agent | | |
| Zelcon PG | 45.2 | 42.4 |
| Viscosity Control Agent | | |
| Bentolite L Clay | — | 6.0 |

-continued

| | | |
|---|---|---|
| Dispersing Aid[d] | | |
| Surfynol 440[l] | 4.0 | 4.0 |
| Total | 100.0 | 100.0 |

[d]Amount given is percentage of the bulk dispersing aid; amount given in parentheses is percentage of the pure active.
[g]Di(hydrogenated tallow)methylbenzylammonium chloride, 75% paste, from Sherex Chemical Company
[h]Stearic hydroxyl imidazoline, from Alkaril Chemicals, Inc.
[i]Methyl-1-hydrogenated tallow amido ethyl-2-hydrogenated tallow imidazolinium methylsulfate, 76% solid, from Sherex Chemical Company.
[j]Ethylbis(polyethoxyethanol)alkylammonium ethylsulfate, 72% aqueous solution, from Sherex Chemical Company.
[k]Nonylphenoxypolyethoxyethanol, from Rohm and Haas Company.
[l]Ethoxylated 2,4,7,9-tetra-5-decyne-4,7-diol, from Air Products & Chemicals, Inc.

Again, the even numbered Examples 14, 16, 26 all yield stable compositions which form substantially uniform coatings on flexible substrates for dryer fabric conditioning.

What is claimed is:

1. An article of manufacture adapted for providing fabric soil release and softening benefits within an automatic clothes dryer, said article comprising:

(a) a fabric conditioning composition being solid at room temperature and flowable at higher dryer operating temperatures, said fabric conditioning composition comprising:

i. 1% to 70% of a polymeric soil release agent having a molecular weight of from about 500 to about 60,000;

ii. 0.25% to 20% of a dispersing aid including suitable selected fabric softening material;

iii. 0% to 90% of a fabric softening agent excluding any of said dispersing aid fabric softening material; and iv. 0.25% to 10% of a viscosity control agent;

wherein said dispersing aid improves the stability and the uniformity of said solid fabric conditioning composition; and wherein said composition contains at least a total level of about 20% of said fabric softening material and said fabric softening agent; and (b) a dispensing means which provides for release of said conditioning composition within an automatic laundry dryer at dryer operating temperatures of from about 35° C. up to about 115° C.

2. An article according to claim 1 wherein the polymeric soil release agent is a copolymer having blocks of ethyleneterephthalate and polyoxyethylene and wherein said dispersing aid is selected from the group consisting of:

(i) alkaline metal and ammonium salts of aromatic sulfonic acids or substituted aromatic sulfonic acids having the formula:

$$(R_1)_n Ar—SO_3M$$

wherein Ar is an aromatic hydrocarbon group, each $R_1$ is a hydrogen radical or a $C_1$–$C_4$ alkyl group, n is from 0 to 3, and M is an alkaline metal or ammonium ion;

(ii) molecules or salts containing an aromatic moiety and a long chain acyclic aliphatic moiety, said molecules or salts having the formula:

$$[R_1—Ar—(CH_2)_u—D—(R_2)_m]A$$

wherein Ar and $R_1$ are defined as above, $R_2$ is an acyclic aliphatic $C_{12}$–$C_{22}$ hydrocarbon group, u is 0 or 1, m is 1 or 2, D is a connecting group, and A is a counterion in the case said D group has a charge;

(iii) N-substituted pyridinium salts having the formula

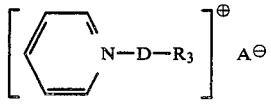

wherein $R_3$ is an acyclic aliphatic $C_{11}$–$C_{21}$ hydrocarbon group, and D and A are defined as above;

(iv) substituted imidazoline compounds having the formula

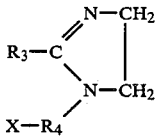

wherein $R_3$ is defined as above, $R_4$ is a divalent $C_1$–$C_3$ alkylene group, and X is selected from a group consisting of hydroxy, —OCO—$R_3$ or —NH—CO—$R_3$ group;

(v) substituted imidazolinium salts having the formula

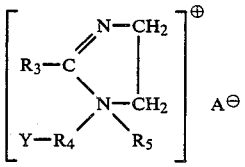

where $R_5$ is a hydrogen radical or a $C_1$–$C_4$ alkyl or hydroxyalkyl group, Y is selected from a group consisting of a hydrogen radical, a $C_1$–$C_2$ alkyl or hydroxyalkyl group, —NH—CO—$R_3$ or —O-CO—$R_3$ group, and $R_3$ and A are defined as above;

(vi) molecules or salts containing a long chain acyclic aliphatic moiety and a polyoxyethylene moiety, said molecules of salts having the formula

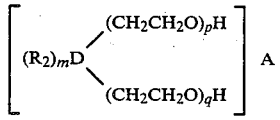

wherein $R_2$, D, A and m are defined as above, p and q are equal from 0 to 30 with p+q equal from 2 to 30;

(vii) polyoxyethylated alkylphenol having the formula:

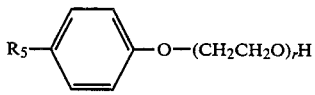

wherein $R_5$ is a straight or branched chain acyclic aliphatic $C_8$–$C_{22}$ hydrocarbon group and r is from 0 to 30;

(viii) molecules having the formula

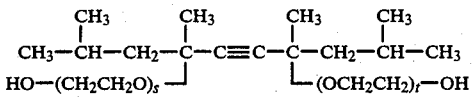

wherein s+t is equal from 2 to 30; and (ix) amine oxides having the formula $R_1R_6R_7NO$ wherein $R_1$ is defined as above, $R_6$ is a $C_8$–$C_{22}$ hydrocarbon group and $R_7$ is selected from the group consisting of $R_1$ and $R_6$ groups; and (x) N-alkyl pyrrolidones having the formula:

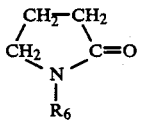

wherein $R_6$ is an acyclic aliphatic defined as above; and mixtures thereof.

3. The article according to claim 2 wherein said polymeric soil release agent is present at a level of from about 10% to about 60%, said dispersing aid is present at a level of from about 1% to about 10%, said fabric softening agent is present at a level of from about 30% to about 80%, and said viscosity control agent is present at a level of from about 1% to about 10%, all by weight of the fabric conditioning composition.

4. The article according to claim 3 wherein said polymeric soil release agent is present at a level of from about 20% to about 50%, said dispersing aid is present at a level of from about 2% to about 7%, said fabric softening agent is present at a level of from about 40% to about 70%, and said viscosity control agent is present at a level of from about 3% to about 8%.

5. The article of claim 3 wherein said dispersing aid is sodium cumenesulfonate.

6. The article of claim 3 wherein the soil release agent is a polymer comprising repeating units of ethylene terephthalate and polyoxyethylene terephthalate at a molar ratio of ethylene terephthalate units to polyoxyethylene terephthalate units of from about 25:75 to about 35:65, said polyoxyethylene terephthalate containing polyoxyethylene blocks having a molecular weight of from about 300 to about 2,000; the molecular weight of said soil release polymer being in the range of from about 25,000 to about 55,000.

7. The article of claim 3 wherein said polymeric soil release agent is a crystallizable polyester with repeat units of ethylene terephthalate units containing 10–50% by weight of ethylene terephthalate units together with 50–90% by weight of polyoxyethylene terephthalate units, derived from a polyethylene glycol of average molecular weight of from about 300 to about 6,000, and the molar ratio of ethylene terephthalate units to polyoxyethylene terephthalate units in the crystallizable polymeric compound is between 2:1 and 6:1.

8. The article of claim 7 wherein said polyoxyethylene terephthalate units are derived from a polyethylene glycol of average molecular weight of from about 1,000 to about 6,000.

9. The article of claim 8 wherein said polyethylene glycol has an average molecular weight of about 1500.

10. The article of claim 3 wherein said polymeric soil release agent has the following formula:

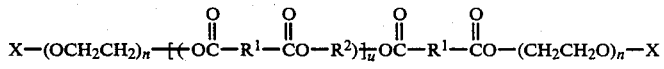

wherein each $R^1$ is a 1,4-phenylene moiety; the $R^2$ consist essentially of ethylene moieties, 1,2-propylene moieties or a mixture thereof; each X is ethyl or methyl; each n is from about 12 to about 43; u is from about 1 to about 10.

11. The article of claim 1 wherein the soil release agent is selected from soil release agents having a molecular weight of at least 5,000 or a viscosity of at least about 5,000 centipoise at 85° C., and mixtures thereof.

12. The article of claim 3 wherein said fabric softening agent is selected from cationic and nonionic fabric softening agents, and mixtures thereof.

13. The article of claim 12 wherein said cationic softening agent is selected from the group consisting of:

(a) acyclic quaternary ammonium salts having the formula:

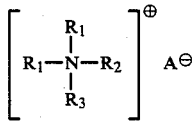

wherein $R_1$ is an acyclic aliphatic $C_{12}$–$C_{22}$ hydrocarbon group, $R_2$ is a $C_1$–$C_4$ alkyl or hydroxyalkyl group, $R_3$ is selected from the group consisting of $R_1$ and $R_2$ groups, and A is an anion preferably selected from the group consisting of methylsulfate, ethylsulfate and chloride ions; and (b) fatty acid salts of tertiary alkyl amines having the formula:

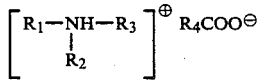

wherein $R_1$, $R_2$ and $R_3$ are defined as above and $R_4$ is an acyclic aliphatic $C_{11}$–$C_{21}$ hydrocarbon group; and mixtures thereof.

14. The article of claim 13 wherein said nonionic softening agent is selected from the group consisting of $C_{12}$–$C_{22}$ fatty alcohols and fatty amines having the formula $R_1R_2R_3N$ wherein $R_1$ is an acyclic aliphatic $C_{12}$–$C_{22}$ hydrocarbon group, $R_2$ is a $C_1$–$C_4$ alkyl or hydroxyalkyl group, and $R_3$ is selected from the group consisting of $R_1$ and $R_2$ groups, and mixtures of said fatty alcohols and fatty amines.

15. The article of claim 1 wherein the dispersing means comprises a flexible substrate in a sheet configuration having the softening composition releasably affixed thereto, and wherein when said dispensing means is a flexible substrate in sheet configuration the fabric conditioning composition is releasably affixed on said substrate to provide a weight ratio of conditioning composition to dry substrate ranging from about 10:1 to about 0.5:1.

16. The article of claim 15 wherein the nonwoven cloth substrate comprises cellulosic fibers, said fibers having a length of from 3/16 inch to 2 inches and a denier of from 1.5 to 5 and wherein said substrate is adhesively bonded together with a binder resin, and wherein the weight ratio of conditioning composition to substrate on a dry weight basis ranges from about 5:1 to 1:1.

17. The article of claim 15 wherein the flexible substrate has openings sufficient in size and number to reduce restriction by said article of the flow of air through an automatic laundry dryer.

18. The article of claim 17 wherein the openings comprise a plurality of rectilinear slits extended along one dimension of the substrate.

19. A method for imparting an improved combination of soil release, softening and antistatic effects to fabrics in an automatic laundry dryer comprising commingling pieces of damp fabrics by tumbling said fabrics under heat in an automatic clothes dryer with an effective amount of a fabric conditioning composition, said composition being solid at room temperatures and flowable at higher dryer operating temperature, said composition comprising:

i. 1% to 70% of a polymeric soil release agent having a molecular weight of from about 500 to about 60,000;

ii. 0.25% to 20% of a dispersing aid including suitable selected fabric softening material;

iii. 0% to 90% of a fabric softening agent excluding any of said dispersing aid fabric softening material; and iv. 0.25% to 10% of a viscosity control agent;

wherein said dispersing aid improves the stability and the uiformity of said solid fabric conditioning composition:

wherein said composition contains at least a total level of about 20% of said fabric softening material and said fabric softening agent; and wherein the fabric conditioning composition is applied to the fabrics from a flexible substrate.

* * * * *